US005606624A

United States Patent [19]

Damato

[11] Patent Number: 5,606,624

[45] Date of Patent: Feb. 25, 1997

[54] AUDIO APPARATUS DEMONSTRATING

[75] Inventor: Joseph A. Damato, Shrewsbury, Mass.

[73] Assignee: Bose Corporation, Framngham, Mass.

[21] Appl. No.: 304,794

[22] Filed: Sep. 12, 1994

Related U.S. Application Data

[63] Continuation-in-part of Ser. No. 61,202, May 13, 1993.

[51] Int. Cl.[6] ..... H04R 1/02

[52] U.S. Cl. ..... 381/90; 381/123; 340/692; 340/825.36

[58] Field of Search ..... 340/692, 825.36; 360/12; 40/457, 463–465; 345/214; 381/61, 18, 17, 24, 90, 42, 88, 87, 188, 123; 379/41, 51, 101

[56] References Cited

U.S. PATENT DOCUMENTS

| | | | |
|---|---|---|---|
| 4,853,678 | 8/1989 | Bishop, Jr. et al. | 340/573 |
| 4,904,983 | 2/1990 | Mitchell | 379/41 |
| 4,907,079 | 3/1990 | Turner et al. | 381/42 |
| 4,912,457 | 3/1990 | Ladd | 340/692 |
| 5,036,472 | 7/1991 | Buckley et al. | 364/479 |
| 5,117,407 | 5/1992 | Vogel | 360/12 |
| 5,264,822 | 11/1993 | Vogelman et al. | 340/692 |

OTHER PUBLICATIONS

Seavry, Mark, "Hi–Fi Buys goes to the movies . . . ", HFD, V67, N 17, p. 82(1), Apr. 26, 1993.

Olenick, Doug "Harvey Sets Home Theater Stage", HFD, Jul. 25, 1994, p. 74.

*Primary Examiner*—Curtis Kuntz
*Assistant Examiner*—Ping W. Lee
*Attorney, Agent, or Firm*—Fish & Richardson P.C.

[57] ABSTRACT

Audio apparatus demonstrating includes audio apparatus to be demonstrated. A display structure supports the audio apparatus and a digital computer controller. A CD-ROM is coupled to the audio apparatus and the digital computer controller with recorded sound signals for audible reproduction by the audio apparatus in response to selection signals furnished by the digital computer controller. A start demonstration switch is coupled to the digital computer controller. A proximity sensor provides a proximity signal to the digital computer controller when a person enters a predetermined zone around the apparatus to cause the digital computer controller to select a change in the record signal reproduced by the audio system from a first signal to a second signal which second signal encourages the person within the zone to actuated the start demonstration switch and initiate a demonstration of the audio apparatus including audibly reproducing sound signals recorded on the CD-ROM.

9 Claims, 8 Drawing Sheets

AUDIO APPARATUS DEMONSTRATING

This application is a continuation-in-part of application Ser. No. 08/061,202, filed May 13, 1993, for LOUDSPEAKER DEMONSTRATING.

The present invention relates in general to audio apparatus demonstrating and more particularly concerns novel apparatus and techniques for selectively demonstrating audio apparatus, such as music systems, in a retail outlet.

According to the invention, there is audio apparatus, such as a music system, to be demonstrated, a CD-ROM having a plurality of addressable, recorded sound signals, a digital computer controller for selecting respective ones of the addressable recorded sound signals for audible reproduction by the music system at appropriate times, a proximity sensor that provides a signal to the apparatus causing a predetermined inviting sound signal to be reproduced by the music system upon sensing a human being within a predetermined short distance from the apparatus, inviting the human being to select demonstration of the music system, and a user selector, typically comprising a flashing illuminated push-button switch, which, upon actuation by a person provides a signal causing the digital computer controller to send selection signals to the CD-ROM to cause selected recorded sound signals to be reproduced by the music system that identify and/or demonstrate its features and are different from the reproduced inviting signal. According to another feature of the invention there is a cellular telephone coupled to the digital computer controller constructed and arranged to exchange messages with a remote home location, which may provide an indication of the number of demonstrations made each day and/or the times the system should be dormant and active.

Numerous other features, objects and advantages of the invention will become apparent from the following description when read in connection with the accompanying drawings in which.

Figure 1:
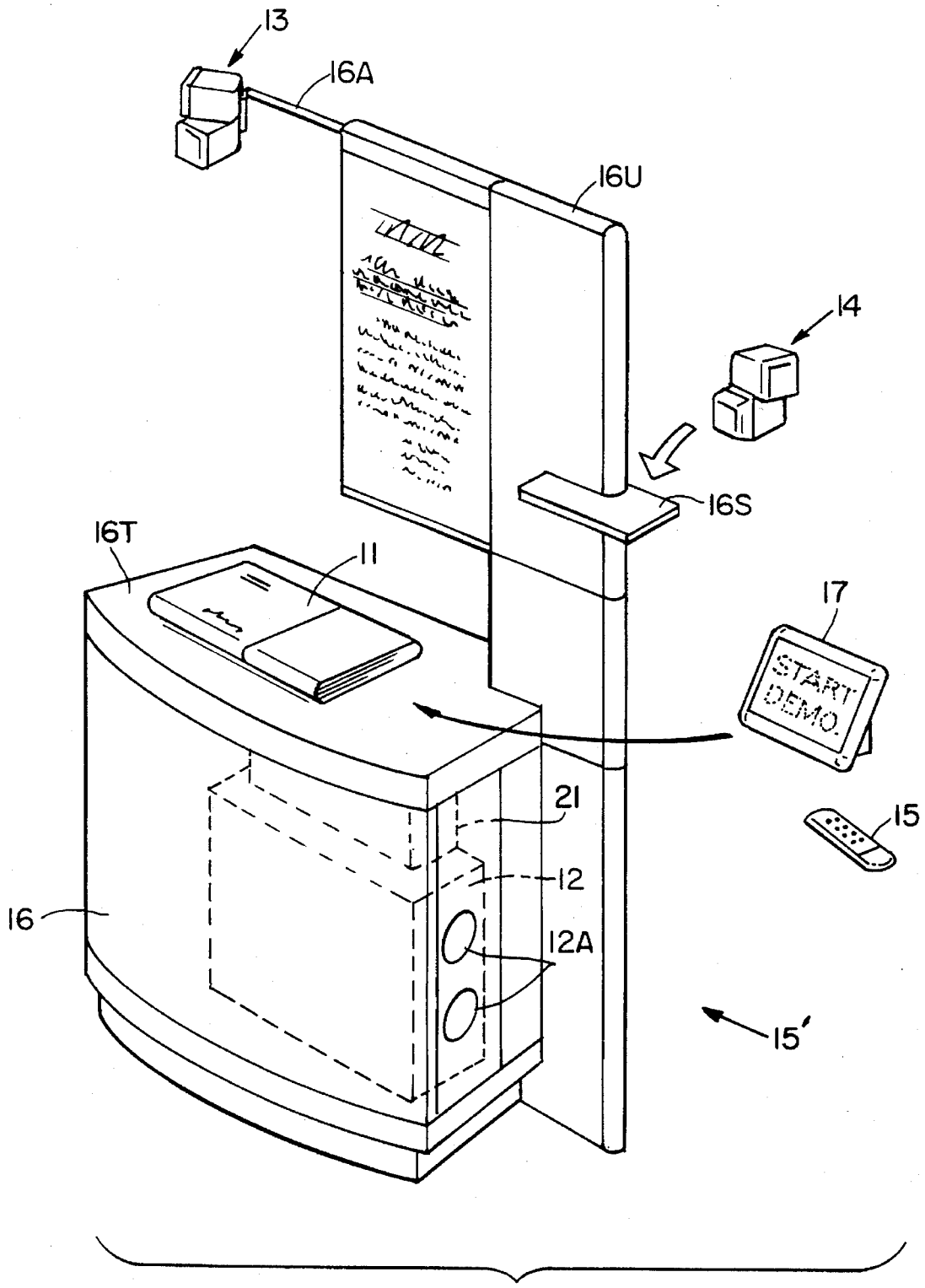
FIG. 1 is a perspective view, partially exploded, of an exemplary embodiment of the invention.

With reference now to the drawings and more particularly FIG. 1 thereof, there is shown a perspective view of an exemplary embodiment of the invention, partially exploded, for demonstrating the commercially available BOSE LIFESTYLE CD-5 music system having a music center 11, woofer module 12, a left pair of upper frequency modules

Figure 2:
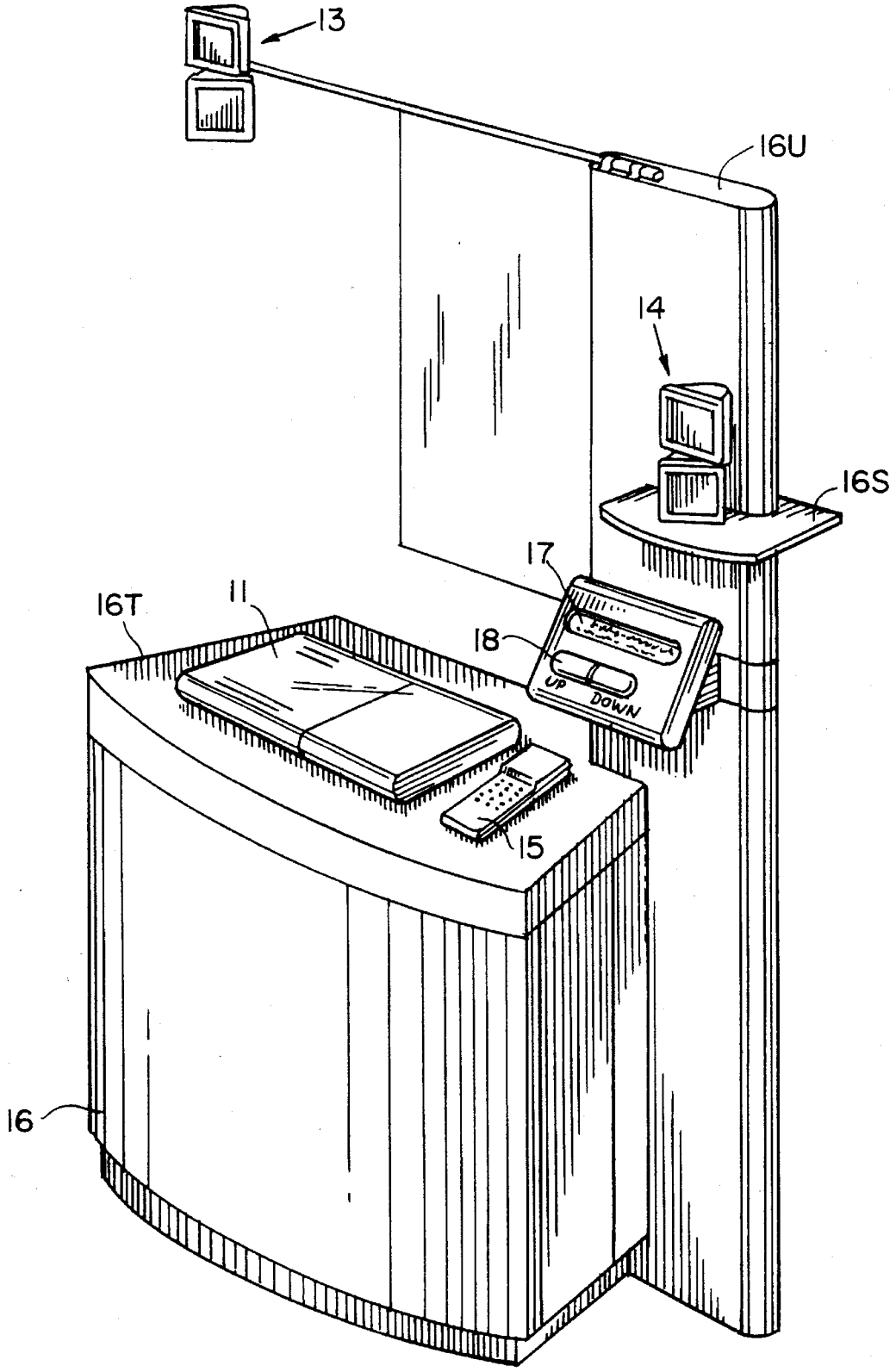
FIG. 2 is a perspective view of substantially the embodiment of FIG. 1 assembled.

13, a right pair of upper frequency modules 14 and a remote controller 15. The pedestal 15' includes a cabinet 16 for supporting music center 11 on the top surface 16T and start demonstration illuminable switch 17 and volume control 18 above the partially open housing that accommodates woofer module 12, with ports 12A exposed, and digital computer controller 21 and other system components (not shown). Upper panel 16U carries an arm 16A supporting left upper frequency module 13 and a shelf 16S supporting right upper frequency modules 14. FIG. 2 is a perspective view of substantially the embodiment of FIG. 1 assembled.

Figure 3:
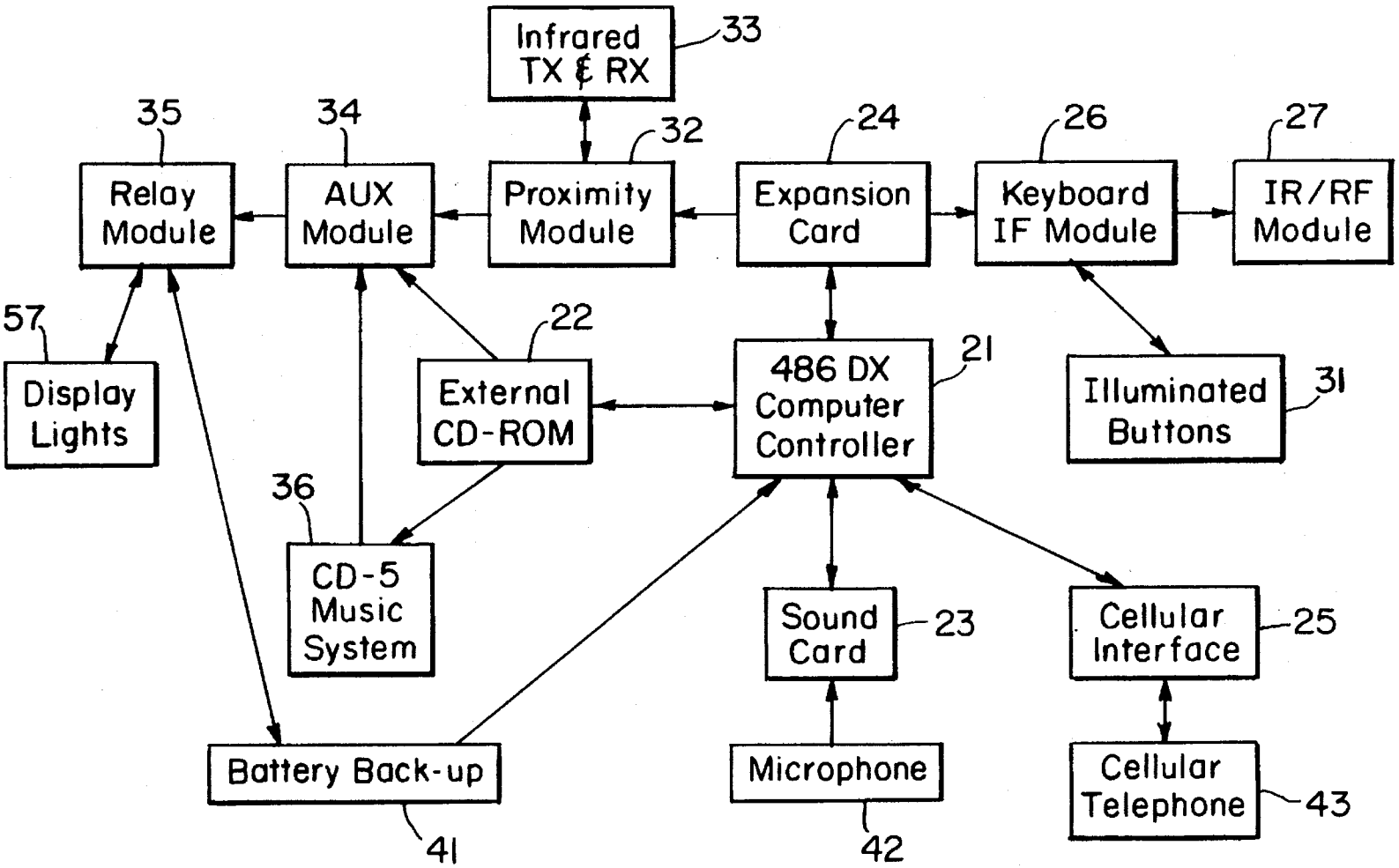
FIG. 3 is a block diagram illustrating the logical arrangement of a system according to the invention.
Figure 4:
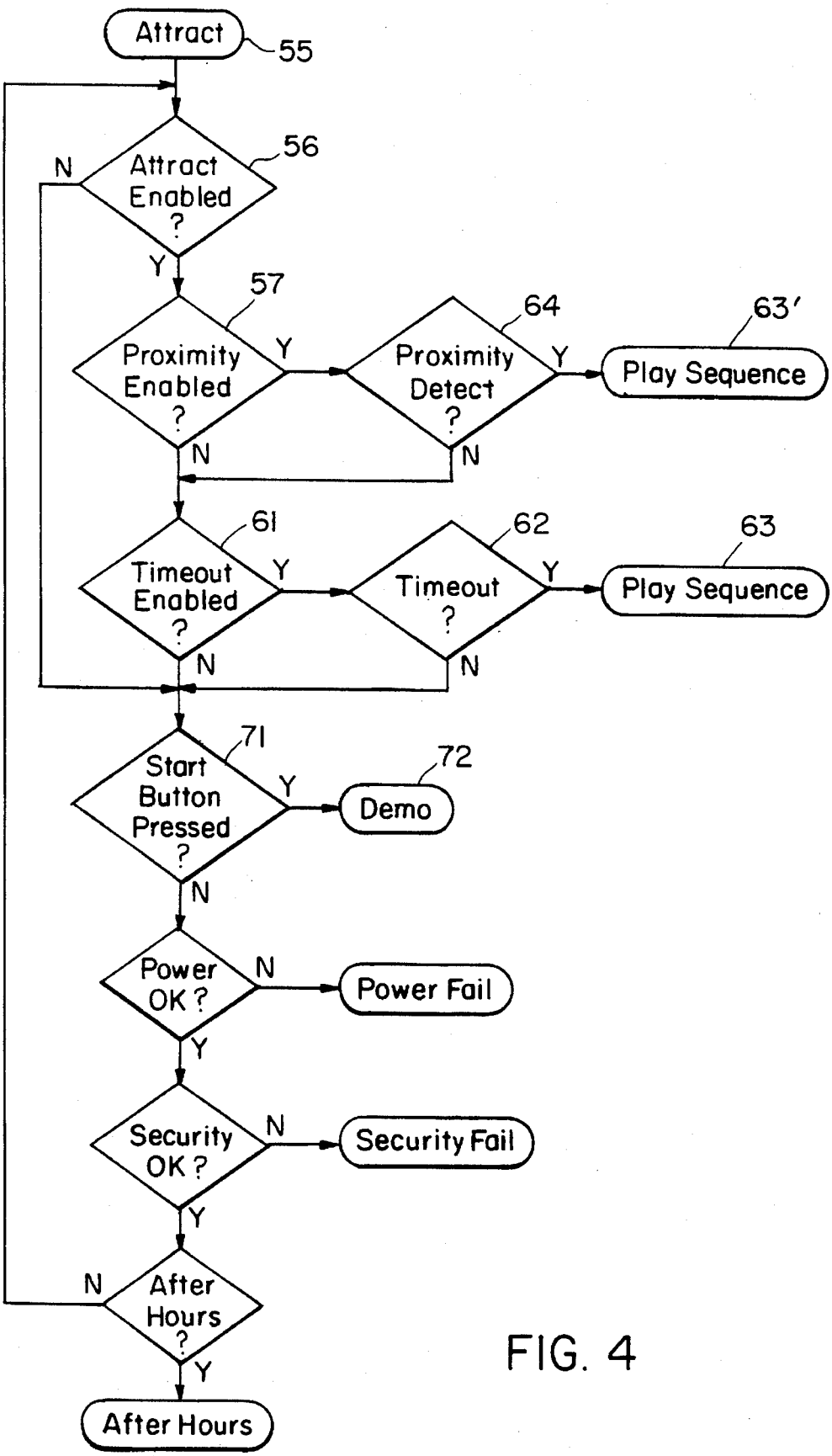
FIG. 4 is a flow diagram illustrating logical decisions carried out by the invention.

Referring to FIG. 3, there is shown a block diagram illustrating the logical arrangement of an exemplary embodiment of a system according to the invention. A 486 digital computer controller 21, typically a commercially available AST personal computer, exchanges signals with CD-ROM 22, with sound card 23, expansion card 24 and cellular interface 25. Expansion card 24 exchanges signals with keyboard interface (IF) module 26 and IR/RF module 27 that interfaces with remote controller 15 (FIG. 1) typically an RF or IR controller. Keyboard IF module 26 also exchanges signals with illuminated buttons 31, typically buttons for demonstration, selection and manual volume control.

Proximity module 32 exchanges signals with infrared transceiver 33 used for sensing a person in the vicinity of the apparatus. Proximity module 32 exchanges signals with auxiliary module 34 that also exchanges signals with relay module 35, CD-5 music system 36 and external CD-ROM 22. Relay module 35 exchanges signals with display lights 37 and battery back-up 41 that furnishes emergency power to digital computer controller 21 in the presence of a power failure.

Sound card 23 receives transduced signals from microphone 42 used for sensing ambient sound level in the vicinity of the apparatus. Cellular interface 25 exchanges signals with cellular telephone 43 for communicating with the central office.

Having described components of the system, its mode of operation will be discussed. During the course of this discussion it will be helpful to consider flow diagrams shown in FIGS. 4–13.

Digital computer controller 21 includes an internal clock and is programmed to maintain the display dormant except during specified hours, typically corresponding to the hours during which the retail outlet where the display is located is open. When the opening time occurs, digital computer controller 21 provides a RESTART signal 51 shown in the flow diagram of FIG. 12. The occurrence of the RESTART signal produces a chain of signals including reset volume signal 52 that resets the volume of music system 36 to a predetermined desired value, reset lamps signal 53 that resets display lights 37, and reset time out signal 54 that provides an ATTRACT signal after a predetermined time interval to initiate the idle state. There is a setup menu which allows selection of using proximity detection of a person to initiate announcements in lieu of timed announcements. Thus, the decision signals furnished by Attract Enabled decision path 56 and Proximity Enabled decision path 57 are both set at setup time. If Proximity Enabled path 57 furnishes a yes signal, during the idle state, signals shown in the flow chart of FIG. 3 occur as the apparatus waits for a person to enter within a predetermined zone around the apparatus. Proximity detector 64 furnishes a Yes signal to cause play sequence 63' to occur. Upon the occurrence of the ATTRACT signal 55 with Attract Enabled decision path 56 set to furnish a yes decision and Proximity Enabled decision path 57 set to furnish a no signal, Timeout Enabled decision path 61 furnishes a yes signal that causes Timeout decision path 62 to indicate a Y decision and provide a PLAY SEQUENCE signal 63. The PLAY SEQUENCE signals, such as 63 and 63' may cause the broadcast of different recorded messages.

With the occurrence of the ATTRACT signal illuminable start demonstration switch 17, typically a green illuminated capacitance switch flashes continually to visually attract a person into pressing it to initiate a demonstration. The occurrence of the PLAY SEQUENCE signal 63 causes a random selection of predetermined recorded messages stored in CD-ROM 22 that are audibly reproduced by music system 36 in an effort to cause a person to actuate switch 17 and initiate a demonstration. Specific recorded attracting messages can be randomly selected or played based on a time-out matrix. This feature involves decision paths 61 and 62.

Proximity module 32 provides a signal when a stationary or moving object (person) is near pedestal 15 through signals provided by infrared transceiver 33. It may be advantageous to divide the region around pedestal 15 into five subzones, each with a coverage in azimuth if about 120 degrees. This feature may be accomplished with five independent yet synchronized IR receivers providing signals representative of object distances as a voltage corresponding to reflected energy originating from a bank of IR emitters comprising IR transceiver 33. The occurrence of a specific voltage reading for a predetermined time period, typically one-two seconds, usually signifies the presence of a moving object that has stopped. Occurrence for this time period is useful in distinguishing between stationary and moving objects. Occurrence of the same voltage reading for a significantly longer period of time signifies detection of an inanimate object. This information is useful in allowing the apparatus to ignore that object when sensing signals representative of proximity in the future. An important advantage of this feature is that the location of the display may be changed without manual recalibration. When decision path 64 indicates proximity detection of a person, PLAY SEQUENCE signal 63' occurs, causing computer controller 21 to furnish signals to CD-ROM 22 selecting recorded sound signals for audible reproduction attempting to persuade the person to initiate a demonstration by actuating switch 17 until the person is outside the predetermined zone around the apparatus. This condition results in an N decision from Proximity Detect decision path 64 to provide a N decision from Timeout Enabled decision path 61 and a N decision from Timeout decision path 62 to initiate PLAY SEQUENCE signal 63 and resume the reproduction of sound signals audibly reproduced while waiting for a person to enter the predetermined zone as described above. Depending on initial setup as discussed above, there is either timeout operation with periodic occurrence of PLAY SEQUENCE signal 63 causing periodic broadcast of attracting announcements or proximity detect operation with occurrence of PLAY SEQUENCE signal 63' causing broadcast of an attracting announcement only upon detecting a person in the predetermined zone.

A feature of the invention is the ability to measure changes in the ambient sound level of the environment around the apparatus using sound card 23, microphone 42 and suitable software. The apparatus continually measures ambient sound levels while in the idle state and music system 36 not furnishing sound and furnishes an ambient sound level signal representative of the ambient sound level that digital computer controller 21 may use to establish the start demonstration volume level 52 of FIG. 12. This volume level increases and decreases in accordance with the sensed averaged ambient sound level.

Figure 12:
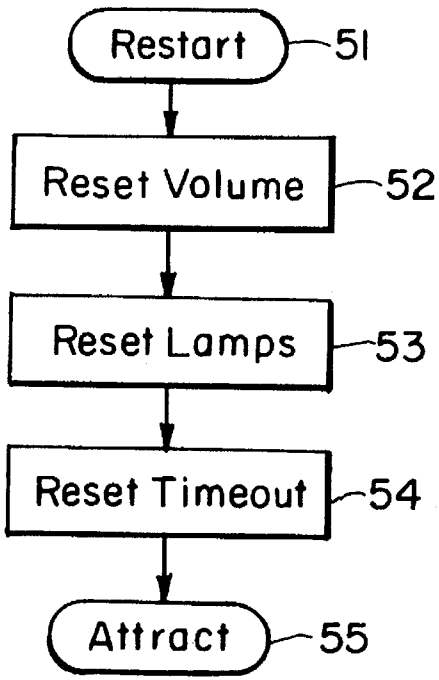
FIG. 12 is a flow diagram illustrating decisions carried out when restart occurs.

Preferably once start demonstration switch 17 has been pressed, digital computer controller 21 causes display lights 37 to remain illuminated (to confirm a change in operation) and sends signals to CD-ROM 22 to deliver a sequence of recorded signals to music system 36 consisting of a series of audible comments describing the product and musical selections demonstrating the features described. At predetermined times digital computer controller 21 furnishes signals to illuminated buttons 31 for sequentially illuminating two volume control switches, one allowing selection of increased volume, the other allowing selection of decreased volume while restricting the available volume change between a specified range, typically approximately ±14 db from the start level set by reset volume 52 (FIG. 12).

The end of each short sequence of audibly reproduced recorded signals typically includes audible comments inviting the person to continue the demonstration by again actuating start demonstration switch 17 until IR transceiver 33 and proximity module 32 no longer sense a person within the predetermined zone.

In the exemplary form of the invention demonstrating the commercially available BOSE LIFESTYLE CD-5 music system, digital computer controller 21 furnishes a line level signal to the pre-amplifier section of music center 11 through the AUX input. To ensure that this program material has the ability to play through music system 36, digital computer controller 21 compares output to input and if different, furnishes an RF command through expansion card 24, keyboard IF module 26 and IR/RF module 27 to the associated remote control to switch music center 11 to reproducing the signal on its AUX input.

In this specific example a person may manually select another input source from music center 11, such as the CD player or the FM/AM tuner, thereby interrupting the reproduction of the signals furnished by CD-ROM 22. A feature of this embodiment is the use of AUX module 34 to match the fixed output of CD-ROM 22 and directly comparing it to the fixed output signal from music center 11 for an indication of when the AUX input of music center 11 is not selected, typically by comparing with one of the two stereo channels.

If reproduction of the signals from CD-ROM 22 is interrupted by a change from selecting the AUX input of music center 11, auxiliary module 34 senses a difference between the signals provided by CD-ROM 22 and the fixed output signal provided by music center 11 to provide an interruption signal that causes digital computer controller 21 to reset music center 11 to selecting the AUX input and furnish a signal to CD-ROM 22 causing music system 36 to reproduce an audible signal reporting that the demonstration was interrupted and causing illuminated switch 17 to flash while encouraging the person to restart the demonstration by re-pressing the flashing start demonstration switch 17.

The reproduced recorded signal typically includes language encouraging the person to re-select the source originally intended if the interruption was intentional. Input-to-output compare is disabled if the source is re-selected. However, when IR transceiver 33 and proximity module 32 no longer sense the person within the predetermined zone, digital computer controller 21 furnishes signals to reset the apparatus to select the AUX input of music center 11 and to compare input to output signal again and prepare for entry of the next person into the predetermined zone. Part of the process just described is illustrated in the flow diagram of FIG. 8.

The following is a summary of what occurs during the reset process of FIG. 12. During a demonstration and once a person is no longer sensed within the predetermined zone around the apparatus, the reset or restart process begins. There is the step of reset volume 52 and return of selection of the AUX input of music center 11 as the input source to restore the appropriate demonstration volume and program material furnished by CD-ROM 22. Start demonstration button 17 begins to flash, and the apparatus including infrared transceiver 33 and proximity module 32 are ready for detecting the presence of a person within the predetermined zone.

The invention also includes battery back-up 41 for furnishing power to digital computer controller 21 when AC power fails. If power supply to the system fails, battery back-up 41 furnishes power to digital computer controller 21 to cause transmission of a signal to CD-ROM 22 to effect furnishing a recorded signal to music system 36 announcing that if AC power remains off for more than 5 minutes, this fact will be reported over cellular telephone 43 to the central office. Upon expiration of this time interval, notification occurs through cellular interface 25 and cellular telephone 43. If AC power is restored within the specified time, the apparatus resets.

All the flow diagrams have not been described in detail above. The flow diagrams not described in detail above are helpful in enabling those skilled in the art to associate portions of the detailed description with specific subroutines.

Figure 6:
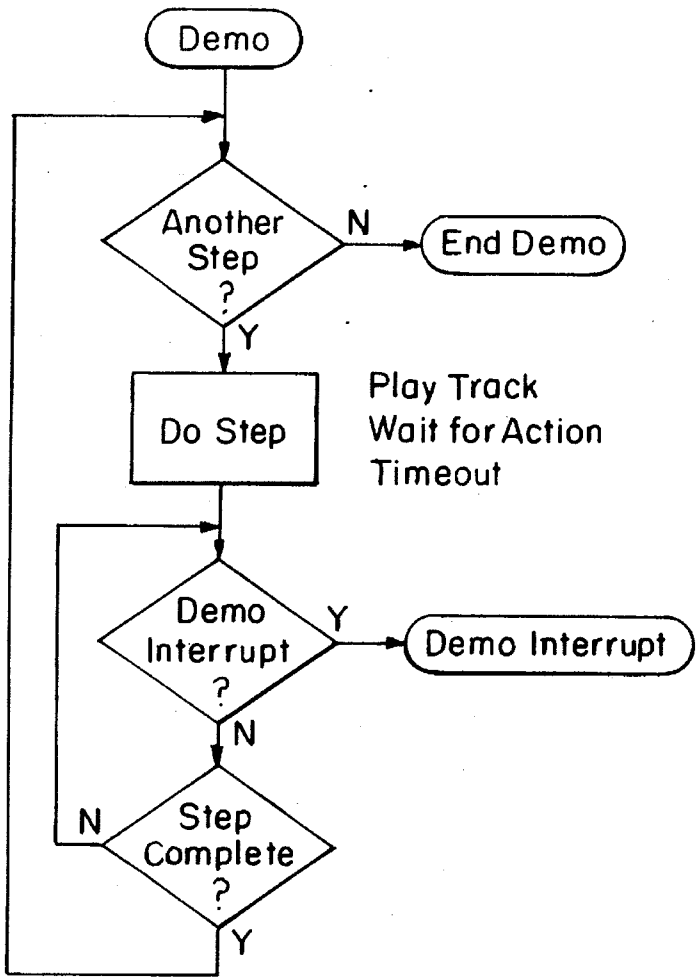
FIG. 6 is a flow diagram illustrating the decisions carried out when a demo has been selected.
Figure 5:
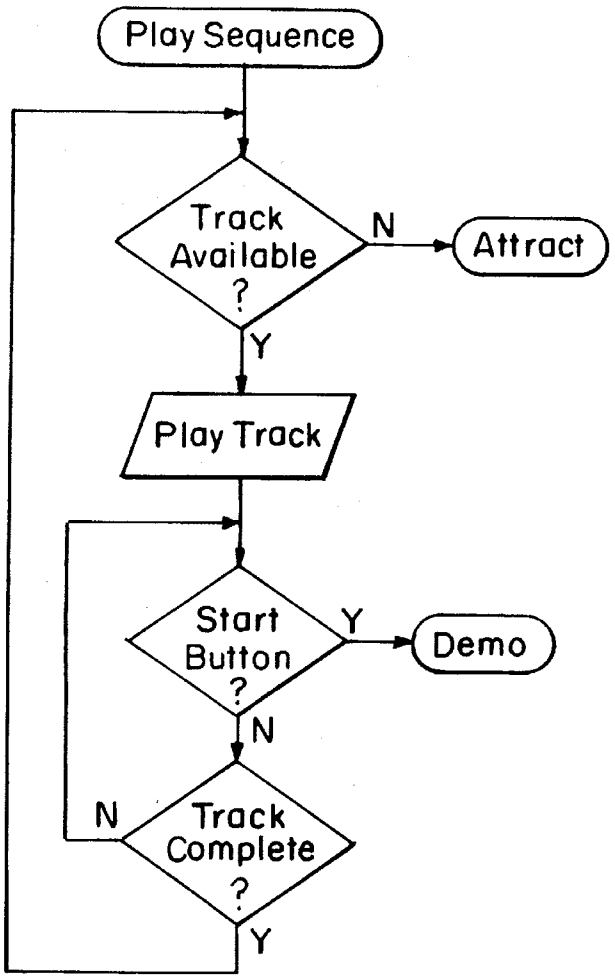
FIG. 5 is a flow diagram illustrating logical decisions carried out upon selecting the play sequence.
Figure 8:
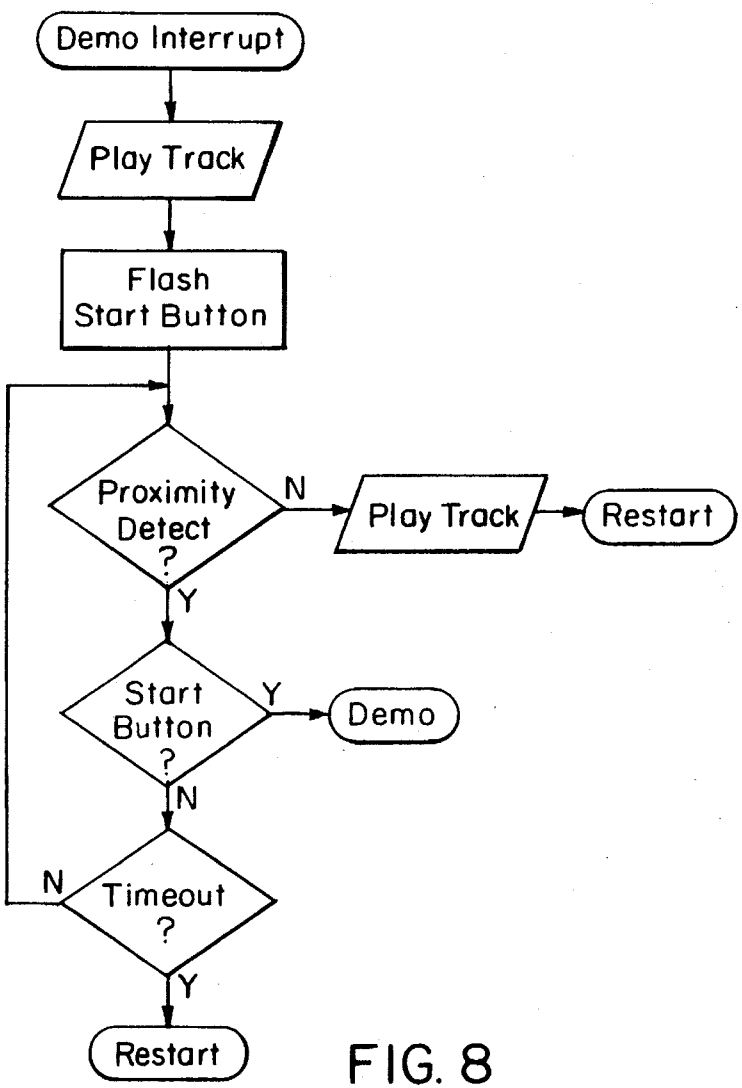
FIG. 8 is a flow diagram illustrating the decisions carried out when a demo interrupt has occurred.
Figure 7:
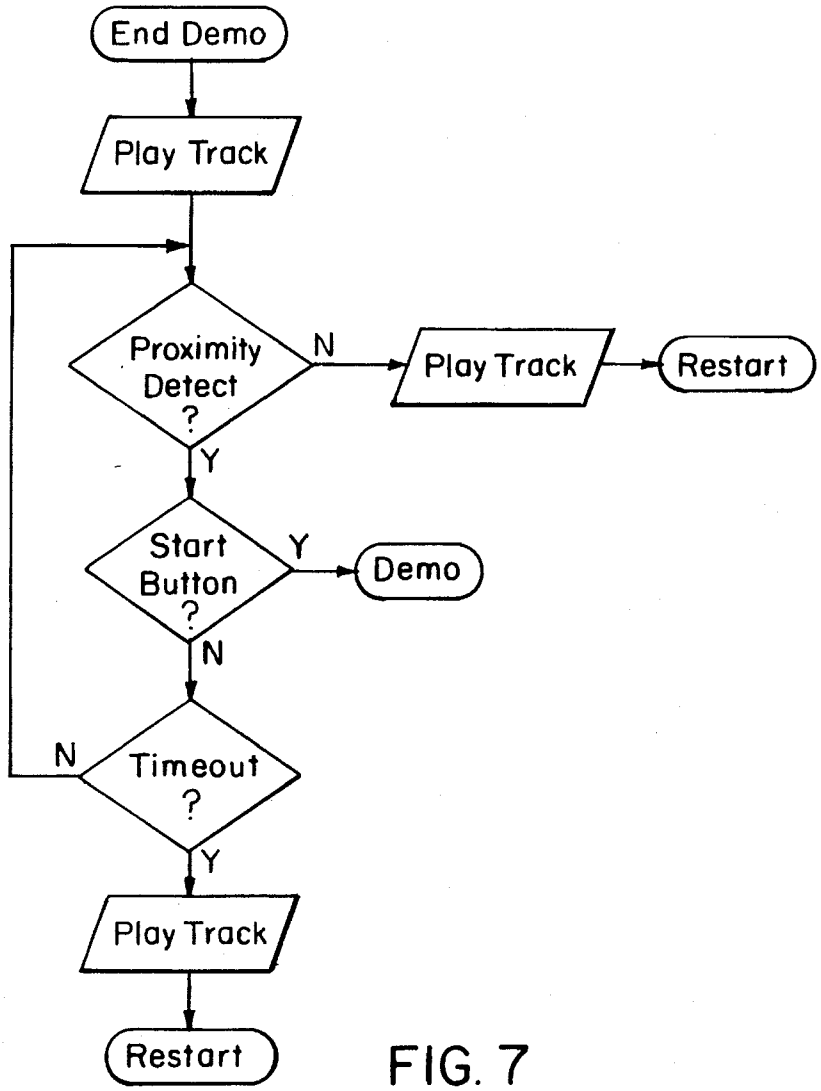
FIG. 7 is a flow diagram illustrating the decisions carried out when end demo has been selected.
Figure 10:
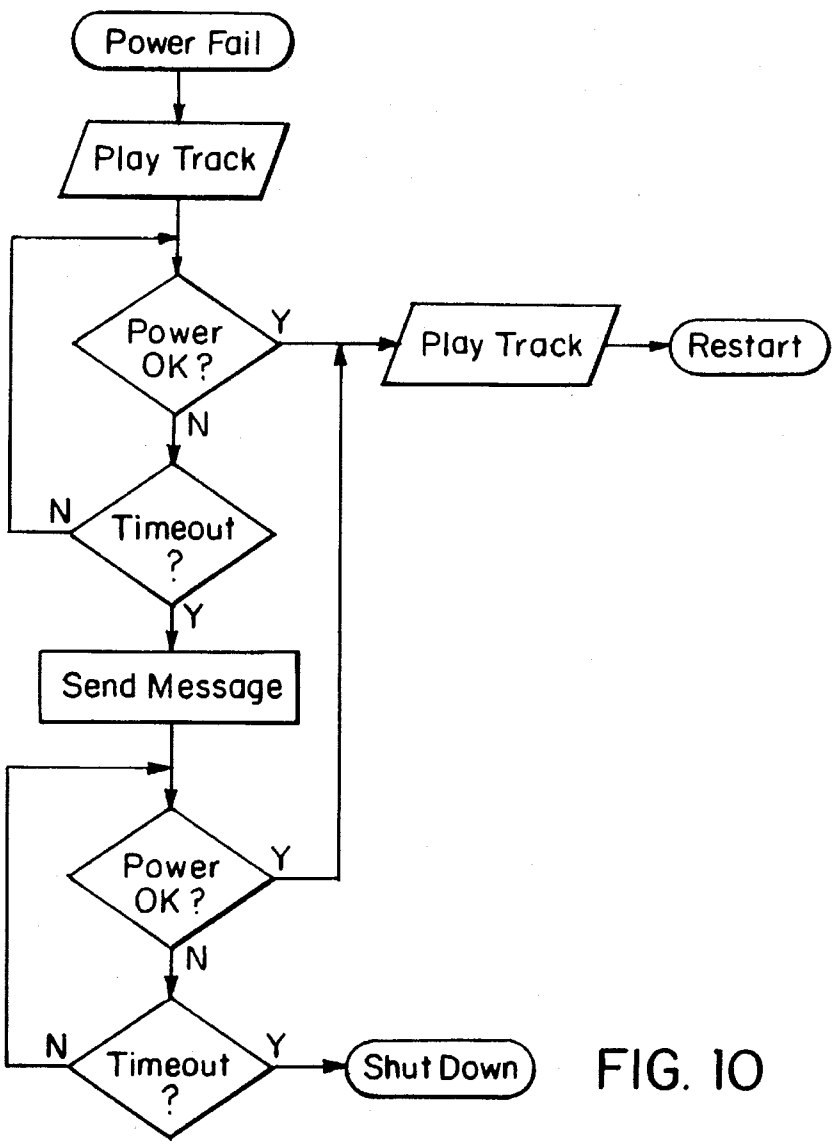
FIG. 10 is a flow diagram illustrating the decisions carried out upon occurrence of a power failure.
Figure 9:
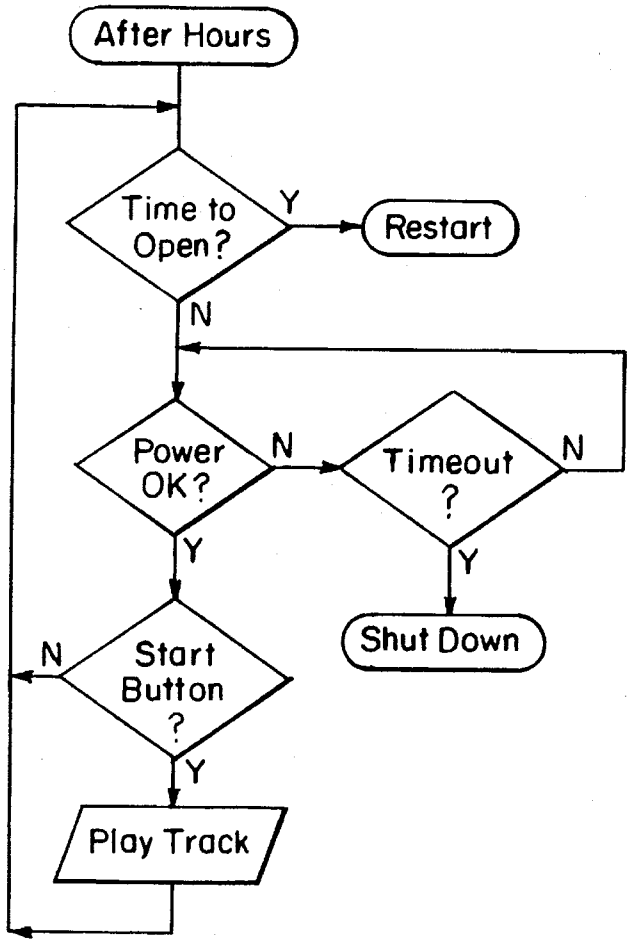
FIG. 9 is a flow diagram illustrating the decisions carried out when after hours has occurred.
Figure 13:
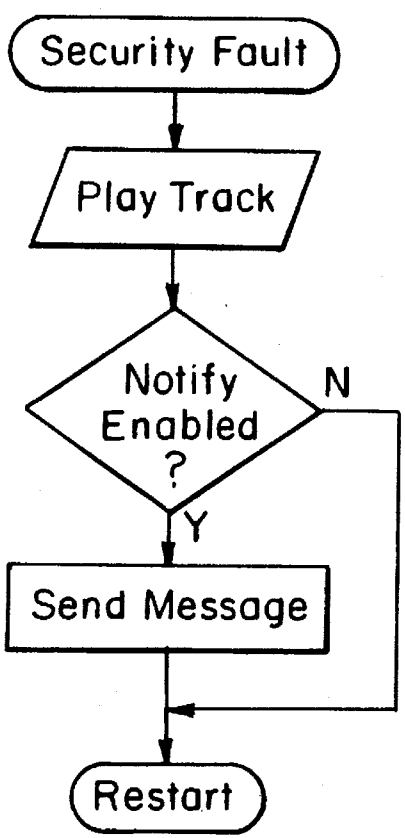
FIG. 13 is a flow diagram illustrating logical decisions carried out upon occurrence of a security fault.
Figure 11:
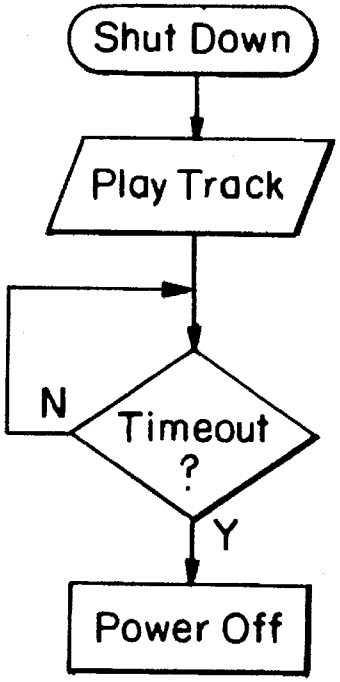
FIG. 11 is a flow diagram illustrating the decisions carried out when shut down occurs.

FIG. 5 illustrates the flow of logical decisions upon occurrence of PLAY SEQUENCE. FIG. 6 illustrates the flow of logical decisions upon occurrence of DEMO. FIG. 7 illustrates the flow of logical decisions upon the occurrence of END DEMO. FIG. 8 illustrates the flow of logical decisions upon occurrence of DEMO INTERRUPT. FIG. 9 illustrates the flow of logical decisions upon occurrence of AFTER HOURS. FIG. 10 illustrates the flow of logical decisions upon the occurrence of POWER FAIL. FIG. 11 illustrates the flow of logical decisions upon the occurrence of SHUT DOWN. FIG. 13 illustrates the flow of logical decisions upon the occurrence of SECURITY FAULT.

Other embodiments are within the claims.

What is claimed is:

1. Audio system demonstrating apparatus comprising, an audio system to be demonstrated, display structure supporting said audio system and a digital computer controller, a CD-ROM coupled to said audio system and said digital computer controller having sound signals recorded thereon for audible reproduction by said audio system in response to selection signals furnished by said digital computer controller, a start demonstration switch coupled to said digital computer controller, and a proximity sensor for providing a signal to said digital computer controller when a person enters a predetermined zone around said apparatus to cause said computer controller to select a change in the recorded signal reproduced by said audio system from a first signal to a second signal which second signal encourages the person within said zone to actuate said start demonstration switch and initiate a demonstration of said audio system including audibly reproducing sound signals recorded on said CD-ROM.

2. Audio system demonstrating apparatus in accordance with claim 1 wherein said computer controller is constructed and arranged to accept setup selection of a first mode rendering said apparatus responsive to said proximity sensor providing a signal to said digital computer controller when a person enters said predetermined zone to cause occurrence of said second signal only when a person is in said predetermined zone and setup selection of a second mode periodically causing occurrence of said second signal independently of the presence of a person in said predetermined zone.

3. Audio system demonstrating apparatus in accordance with claim 2 wherein said start demonstration switch is illuminable and said digital computer controller is constructed and arranged to cause said start demonstration switch to flash upon occurrence of said second signal.

4. Audio system demonstrating apparatus in accordance with claim 1 and further comprising a wireless communication link coupled to said digital computer controller, said digital computer controller constructed and arranged to transmit information signals characterizing said audio demonstrating apparatus through said wireless communication link to a central location station remote from said apparatus.

5. Audio system demonstrating apparatus in accordance with claim 4 wherein said wireless communication link comprises a cellular telephone.

6. Audio system demonstrating apparatus in accordance with claim 1 wherein said start demonstration switch is illuminable and said digital computer controller is constructed and arranged to cause said start demonstration switch to flash upon occurrence of said second signal.

7. A method of demonstrating audio apparatus through actuation of a start demonstration switch comprising, sensing the presence of a person within a predetermined zone around said apparatus to provide a proximity signal, reproducing a recorded first signal with said apparatus to provide a first audible signal, furnishing said proximity signal to a digital computer controller to cause said digital computer controller to select a change in the recorded signal reproduced by said apparatus from said first signal to a second signal which second signal encourages the person within said zone to actuate said start demonstration switch, and reproducing a recorded demonstration signal to provide an audible demonstration signal in response to actuation of said start demonstration switch.

8. Audio system demonstrating apparatus comprising, an audio system to be demonstrated, display structure supporting said audio system and a digital computer controller, a CD-ROM coupled to said audio system and said digital computer controller having sound signals recorded thereon for audible reproduction by said audio system in response to selection signals furnished by said digital computer controller, a start demonstration switch coupled to said digital computer controller, and a wireless communication link coupled to said digital computer controller, said digital computer controller constructed and arranged to transmit information signals characterizing said audio demonstrating apparatus through said wireless communication link to a central location station remote from said apparatus.

9. Audio system demonstrating apparatus in accordance with claim 8 wherein said wireless communication link comprises a cellular telephone.

* * * * *